United States Patent [19]

Howe et al.

[11] 4,440,296

[45] Apr. 3, 1984

[54] ANTI-PROPAGATION EXPLOSIVE PACKAGING

[75] Inventors: Philip M. Howe, Conowingo; Gould Gibbons, Finksburg, both of Md.; Clifford L. Aseltine, Houston; Frank Williams, Rosharon, both of Tex.

[73] Assignee: The United States of America as represented by the Secretary of the Army, Washington, D.C.

[21] Appl. No.: 446,936

[22] Filed: Dec. 6, 1982

[51] Int. Cl.[3] ..... F42B 37/00; F42B 39/00; B65D 85/30

[52] U.S. Cl. ..... 206/3; 206/443; 206/591; 89/34; 220/400

[58] Field of Search ..... 206/3, 443, 591, 521; 89/34; 220/400; 217/43 A

[56] References Cited

U.S. PATENT DOCUMENTS 2,774,474 12/1956 Phillips ..... 206/3

4,222,484 9/1980 Howe ..... 206/3

4,248,342 2/1981 King et al. ..... 206/3

4,286,708 9/1981 Porzel ..... 206/3

*Primary Examiner*—William T. Dixson, Jr.

*Attorney, Agent, or Firm*—Robert P. Gibson; Anthony T. Lane; Harold H. Card, Jr.

[57] ABSTRACT

Propagation of detonation between pallets of munition such as artillery shells is prevented by interposing an inert material having adequate density to render the fragments from a detonating pallet non-lethal when they reach explosive devices in a neighboring pallet. The material must be of a type which does not itself form lethal fragments and the material must be placed sufficiently close to the explosive devices that the fragments from an explosive have not had time to separate into individual pieces but, instead, produce a plate impact on the material. This latter requirement reduces or eliminates the need for any substantial strength in the material.

9 Claims, 3 Drawing Figures

ANTI-PROPAGATION EXPLOSIVE PACKAGING

GOVERNMENTAL INTEREST

The invention described herein was made in the course of a contract with the Government and may be manufactured, used and licensed by or for the Government for Governmental purposes without the payment to us of any royalty thereon.

BACKGROUND OF THE INVENTION

The present invention is related to apparatus for reducing the propagation of explosion from one explosive device to another. In particular, the present invention is related to the prevention of the propagation of explosion from explosive devices in one pallet to other explosive devices nearby.

Munitions are classified according to the damage which can result from accidental or untimely explosion thereof and their susceptibility to untimely or accidental detonation due to impact thereon by fragments produced by a nearby explosion. One of the especially hazardous catagories is the "mass detonating" class of munitions wherein detonation of one munition in close proximity with other similar munitions will cause most or all of the others to detonate.

U.S. Pat. No. 4,222,484 addressed the problem of preventing the detonation of a second munition packed on a pallet with an exploding first munition. This patent disclosed the use of a coherent solid mass of vibration-damping and moisture-resisting material positioned between munitions on lines joining the centers or axes thereof. This material interrupted transmission of shock effects to reduce a likelihood of mass detonation of all of the explosives packed together on a pallet.

When adjacent munitions on a pallet detonate, a focused jet of lethal particles is formed in a symmetry plane between the munition. This focused jet, similar in its effects to a shaped charge munition, greatly enhances the lethality of particles emerging from a plurality of detonating explosive devices on a pallet. The mass focusing in the symmetry plane of detonating 155 mm shells, for example, is capable of perforating in excess of 3.5 inches of rolled homogeneous armor plate.

Thus, the two problems to be solved by the present invention include the detonation of munitions in a nearby location from primary fragments of one or more exploding munitions on a pallet as well as the even more severe threat to nearby munitions of a mass focused jet resulting from the simultaneous or near-simultaneous detonation of two munitions on a pallet.

OBJECTS AND SUMMARY OF THE INVENTION

Accordingly, it is an object of the present invention to provide apparatus for preventing the detonation of explosive devices due to detonation of one or more munitions on a nearby pallet.

It is a further object of the invention to prevent the detonation of explosive devices due to the mass focusing of fragments resulting from interaction of simultaneously or near-simultaneously detonating munitions in a nearby pallet.

It is a further object of the invention to provide apparatus for preventing propagation of explosion between pallets which is compact, lightweight and low cost.

It is a further object of the invention to provide a shield for preventing propagation of detonation of explosives between pallets without requiring modification to existing pallets.

According to an aspect of the present invention, there is provided a shielding apparatus for a plurality of munitions assembled together into a unit, comprising at least a first shield, the first shield containing a material having an areal density high enough to render fragments from the plurality of munitions non-lethal to nearby munitions, the material being incapable itself of forming lethal fragments, and the shield being disposed at distances close enough to at least two adjacent ones of the plurality of munitions that fragments from detonation of one or more of the at least two adjacent ones impact the shield in a plate-like impact.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
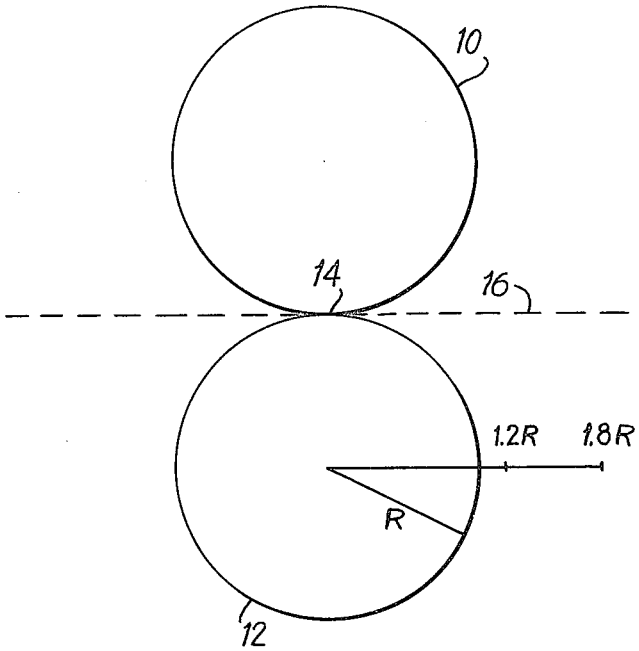
FIG. 1 is a top schematic view of two adjacent cylindrical rounds whose relationship will be employed in explaining the invention.

Referring now to FIG. 1, there is shown adjacent cylindrical munitions 10 and 12 which may be, for example, 155 mm artillery shells. As conventionally packed for storage and shipment, munitions 10 and 12 are disposed in a pallet (not shown in FIG. 1) with their tangent points 14 touching or near-touching.

If munitions 10 and 12 detonate simultaneously or near-simultaneously, a mass focused jet of particles is expelled along a symmetry plane 16 which greatly enhances the destructive effect of the explosion of both of munitions 10 and 12 as compared to the individual explosion of either one.

Figure 2:
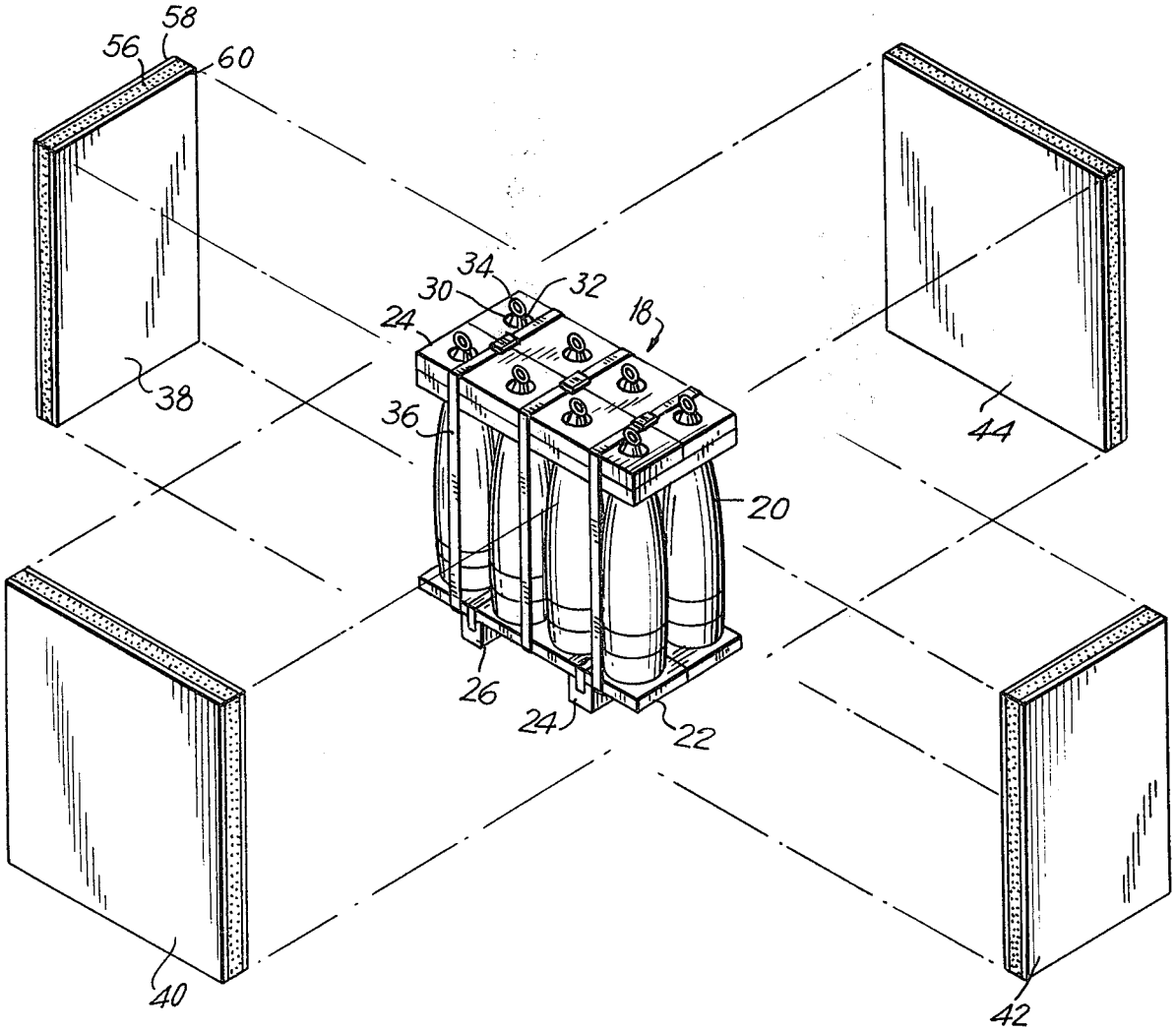
FIG. 2 is a perspective view of a pallet including shielding panels moved away therefrom for clarity of description.

Referring now to FIG. 2, there is shown, generally at 18, a conventional pallet containing eight munitions 20 which may be, for example, 155 mm shells disposed on a lower platform 22. Platform 22 may be of any convenient material but, as is conventional, it is preferably fabricated of wood. Shells 20 are disposed parallel to each other with their tangent points touching or nearly touching adjacent munitions. As is conventional, wooden feet 24 and 26 are attached to the underside of platform 22 to enable a lifting device such as, for example, a lifting fork, to be inserted under pallet 18 for handling thereof.

A retainer plate 28 is disposed at the top end (the forward end of the ogive) of munitions 20 and preferably includes openings 30 through which the extreme forward end 32 of munitions 20 may partly protrude for stabilization thereof. Lifting rings 34, conventionally provided with large munitions 20 are permitted to protrude beyond openings 30.

Platform 22 and retaining plate 28 are clamped in locked condition with munitions 20 using conventional bands 36.

As above described, pallet 18 is conventional in the art with adjacent munitions retained in the positions shown with tangent points 14 of their widest parts touching or near-touching.

Referring again to FIG. 2, four shields 38, 40, 42 and 44, are assembled fitting against the four lateral sides of platform 22 and the retainer plate 28 to form a substantially continuous shield about the sides and ends of pallet 18. Shields 38, 40, 42 and 44 are installed in place in any convenient manner but, in the preferred embodiment, are secured in place by a plurality of bands (not shown) corresponding to bands 36 which encircle them. Preferably, a pair of bands (not shown) are wrapped about and secure opposed shields 40 and 44 to opposed sides of pallet 18 and a similar treatment is given to opposed shields 38 and 42.

Although four shields 38, 40, 42 and 44 are shown encircling a single pallet 18 in FIG. 2, it should not be assumed either that full lateral shielding is always required nor that a shielding arrangement is limited to a single pallet. For example, if the warehousing arrangement permits it, shields may be required only on one pair of opposed sides to protect munitions stacked 180° apart. Further, two or more pallets 18 may be assembled into a single shielded assembly with shields 38, 40, 42 and 44 disposed about the two-pallet or larger assembly.

Figure 3:
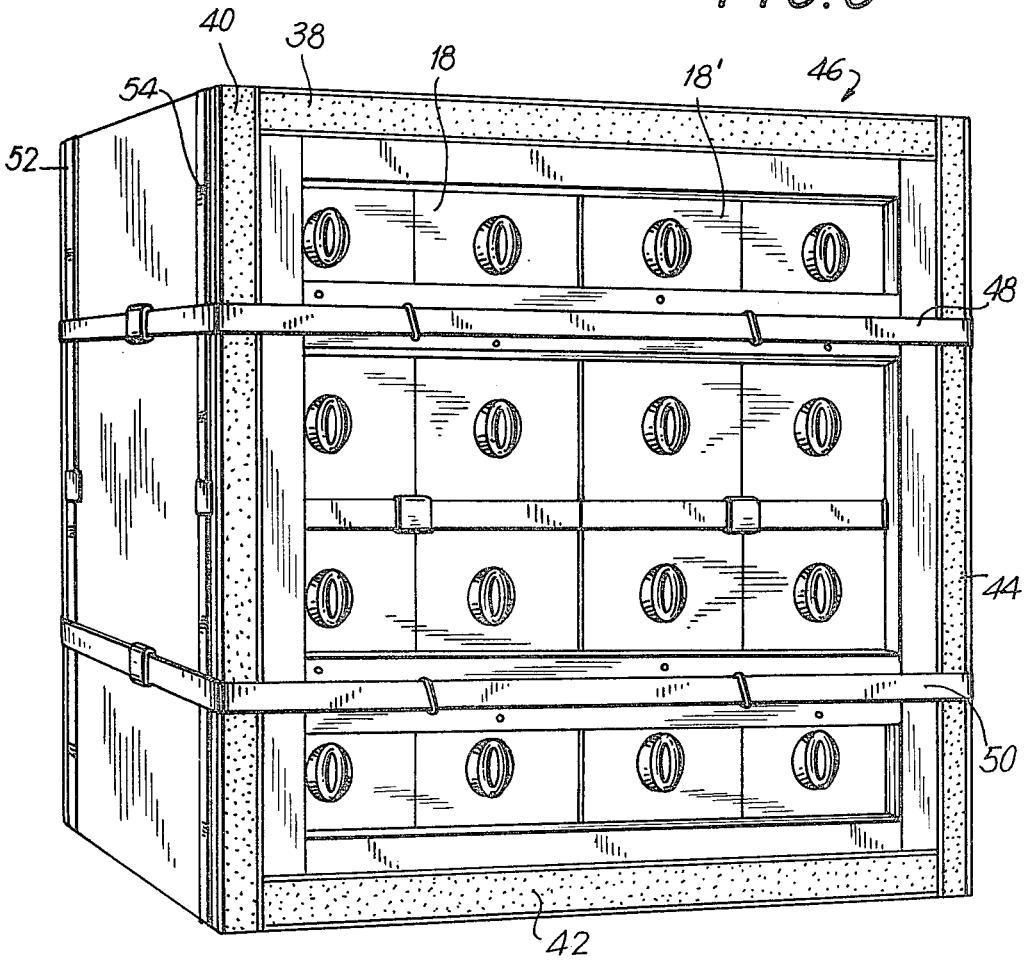
FIG. 3 is a perspective view of a unit made up of two pallets shielded by a set of shielding panels.

Referring now to FIG. 3, a two-pallet shielded assembly 46 is shown in which a first pallet 18 and a second pallet 18' is encircled by shields 38, 40, 42 and 44. Transverse strapping bands 48 and 50 hold shields 40 and 44 against opposed sides of pallets 18 and 18' as well as holding pallets 18 and 18' together in a single unit. Tangential bands 52 and 54 encircle all four shields 38, 40, 42 and 44 thus holding all shields in place as well as enhancing the unification of pallets 18 and 18'.

Returning now to FIG. 2, each of the shields such as, for example, shield 38 includes a core 56 having a sufficient areal density and thickness to render primary fragments from individual rounds as well as the mass focused jet caused by the interaction of adjacent rounds non-lethal to a mass detonating class of munitions spaced a predetermined distance away. An external cladding 58 and an internal cladding 60 retain and protect core 56 from abrasion. As will be explained, neither cladding 58 and 60 nor core 56 requires a great amount of strength. Core 56 need only have sufficient areal density and be of a material which breaks into non-lethal pieces. In the preferred embodiment, commercially available gypsum board normally used for interior walls has been used in core 56. A thickness of about three inches or less is satisfactory to prevent detonation of nearby munitions when probably installed. Cladding 58 and 60 may be any convenient material having sufficient abrasion resistance such as, for example, plywood, fiber board, cardboard, and the like. External cladding 58, in particular, must be capable of resisting abrasion and breakage. Internal cladding 60 may be of the same or a different material.

Referring again to FIG. 1, the applicant has discovered that the shields must be positioned within from about 1.2 to about 1.8 radii R of the axes of munitions 10 and 12 in order that the expanding casing has insufficient time to break up into separate fragments. This applies also to the interacting fragments along symmetry plane 16. Since the impact on the shields is a plate impact, high tensile strength of the shields is not required. Instead, the shields need only have sufficient areal density and be incapable of themselves breaking into lethal fragments. These requirements are satisfied by conventional gypsum board or other conventional materials.

Returning to FIG. 2, it would be clear that, although shields 38, 40, 42 and 44 may be placed very close to, or touching, munitions 20 at their widest points, they are spaced substantially further away at the forward ends 32. This may be satisfactory since the focused jet along the symmetry plane becomes less well developed due to the greater separation between the surfaces of the munitions in this region.

It would be clear to one skilled in the art that shields for other size munitions may be appropriately scaled in thickness according to the above teachings for a particular case.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A shielding apparatus for a plurality of munitions assembled together into a unit, comprising:

at least a first shield;

said first shield containing a material having an areal density high enough to render fragments from said plurality of munitions non-lethal to nearby munitions;

said material being incapable itself of forming lethal fragments; and said shield being disposed at distances close enough to at least two adjacent ones of said plurality of munitions that fragments from detonation of one or more of said at least two adjacent ones impact said shield in a plate-like impact.

2. A shielding apparatus according to claim 1, wherein said material is a sheet of gypsum.

3. A shielding apparatus according to claim 2, wherein said sheet of gypsum is clad with at least an abrasion resisting external cladding.

4. A shielding apparatus according to claim 3, wherein said external cladding is particle board.

5. A shielding apparatus according to claim 1, wherein said distances are less than 1.8 radii of said at least two adjacent ones from axes of said at least two adjacent ones.

6. A shielding apparatus according to claim 5, wherein said distances are 1.2 radii.

7. A shielding apparatus according to claim 1, wherein said unit includes a pallet having first, second, third and fourth sides and said at least a first shield includes first, second, third and fourth shields fittable respectively on said first, second, third and fourth sides.

8. A shielding apparatus according to claim 7, further comprising strapping for retaining said first, second, third and fourth shields in place.

9. A shielding apparatus according to claim 1, wherein said unit includes at least two pallets of said munitions assembled to have collectively first, second, third and fourth sides, and said at least a first shield includes first, second, third and fourth shields fittable respectively on said first, second, third and fourth sides.

* * * * *